US006054664A

United States Patent [19]

Ariga et al.

[11] Patent Number: 6,054,664

[45] Date of Patent: Apr. 25, 2000

[54] MEMBRANE SWITCH WITH MIGRATION SUPPRESSION FEATURE

[75] Inventors: Katsuhiko Ariga, Obu; Takaaki Yamamoto, Okazaki, both of Japan

[73] Assignee: Denso Corporation, Kariya, Japan

[21] Appl. No.: 09/246,150

[22] Filed: Feb. 8, 1999

[30] Foreign Application Priority Data

Feb. 24, 1998 [JP] Japan ..... 10-060495
Sep. 25, 1998 [JP] Japan ..... 10-288927

[51] Int. Cl.[7] ..... H01H 1/02

[52] U.S. Cl. ..... 200/512; 200/268

[58] Field of Search ..... 200/5 A, 511–517, 200/268, 269

[56] References Cited

U.S. PATENT DOCUMENTS 4,249,044 2/1981 Larson ..... 200/5 A
4,301,337 11/1981 Eventoff ..... 200/5 A
4,405,849 9/1983 Frame ..... 200/262
4,415,780 11/1983 Daugherty et al. ..... 200/5 A
4,421,958 12/1983 Kameda ..... 200/5 A
4,701,579 10/1987 Kurachi et al. ..... 200/5 A
4,847,452 7/1989 Inaba ..... 200/5 A

FOREIGN PATENT DOCUMENTS 62-153724 9/1987 Japan ..... H01H 13/70

*Primary Examiner*—Michael Friedhofer
*Attorney, Agent, or Firm*—Pillsbury Madison & Sutro LLP

[57] ABSTRACT

A membrane switch that suppresses the growth, or migration, of metallic ion crystals caused by condensation. First and second metallic conductive layers are provided on an inside of the first and second resin film, respectively. First and second non-metallic conductive layers cover the first and second metallic conductive layers, respectively. A spacer separates the first and second metallic conductive layers and includes an inner wall that, together with the first and second metallic conductive layers, defines a spacer cavity. At least one of the first and second metallic conductive layers is located a prescribed distance from the spacer inner wall, as the spacer inner wall provides a pathway for the metallic ion crystal migration.

11 Claims, 6 Drawing Sheets

MEMBRANE SWITCH WITH MIGRATION SUPPRESSION FEATURE

CROSS-REFERENCE TO RELATED APPLICATION

The present invention is related to, and claims priority from, Japanese Patent Applications Hei. 10-60495, filed Feb. 24, 1998, and Hei. 10-288927, filed Sep. 25, 1998, the contents of which are incorporated herein by reference.

BACKGROUND

1. Field of the Invention

The present invention relates generally to membrane switches, and particularly to a membrane switch in which migration of metallic ions among contact points due to moisture is suppressed.

2. Related Art

A membrane switch 200 having a structure shown in FIGS. 8A and 8B is well known. Such a membrane switch 200 includes two opposing flexible printed circuits (hereinafter referred to as FPCs) 21, 22 separated by a predetermined distance. When pressure is applied to a contact part (region indicated by X in FIG. 8B), the FPCs 21, 22 contact each other, and conduction occurs.

FPCs 21, 22 are composed, for example, of resin films 211, 212, such as polyethyleneterephthalate (PET), having printed or laminated thereon highly conductive metallic conductive layers formed from copper or silver, such as those shown at 221, 222. After the metallic conductive layers are laminated to the resin films, an electrical circuit is formed thereon by, for example, etching.

The resulting circuit forms a contact part indicated by region X, an inner wiring part indicated by region Y, and an outer wiring part indicated by region Z which connects the inner wiring part Y to an outer circuit (not shown).

While a thick copper or silver film exhibits excellent conductivity, the resistance of such a film increases as oxidation and corrosion of the metallic material occurs. Therefore, resin films 231, 232, which are conductive due to dispersion of carbon particles therein, are formed as protective layers on the metallic conductive layers 221, 222. The resin conductive layers 231, 232 cover the metallic conductive layers 221, 222, respectively, to protect the metallic conductive layers from oxidation and corrosion. Thus, the metallic conductive layer 221 and the resin conductive layer 231, as does the metallic conductive layer 222 and the resin conductive layer 232, form a conductive part of the switch.

When pressure is applied to the X region, the resin conductive layers 231, 232 contact each other, but the metallic conductive layers 221, 222 do not contact each other. Hereinafter, the metallic conductive layer and a non-metallic conductive layer, such as the resin conductive layer, will together be referred to as a conductive part.

Further, in the membrane switch 200, the FPCs 21, 22 sandwich a spacer 24. The spacer 24 is typically formed from an insulating material having a prescribed thickness so that the opposing contact parts X of the FPCs 21, 22 are separated by a predetermined distance. Therefore, after lamination, a cavity 240 between the sealed contact parts is formed by the contact parts X and a spacer side wall 241.

When pressure is applied to the contact parts X, the resin films 211, 212 are deformed so that contacts 261, 262 on the surface of the resin conductive layers 231, 232 contact each other to form an ON state. When the pressure is removed, the contacts 261, 262 are separated from each other to form an OFF state.

However, because the two FPCs 21, 22 are laminated via an adhesive, a minute gap is often formed between two or more of the FPC layers during lamination. Therefore, when the membrane switch 200 gets wet, water may reach the cavity 240 through these minute gaps. Similarly, under high humidity conditions, water vapor may penetrate the membrane switch through a breathe hole (not shown) provided to facilitate stable mechanical operation of the contacts, resulting in water condensation in the cavity 240. Furthermore, water may become trapped inside the membrane switch as the switch is washed during the manufacturing process, and as a result dew condensation may occur in the cavity during low temperature conditions.

When water is present in the cavity 240 and on the side wall 241, it is repeatedly subjected to vaporization and condensation, and gradually penetrates the resin conductive layers 231, 232. As a result, some of the metal contained in the resin conductive layers 231, 232 is ionized.

When an electric field is applied to the contact parts X for a long period of time under such conditions, metallic ions can be transmitted from the metallic conductive layer of the positive electrode 221 (or 222) through the resin conductive layer 231 (or 232). The transmitted metallic ions form metallic crystals on the side wall 241, which gradually grow from the metallic layer of the positive electrode to the metallic layer of the negative electrode due to a leakage current. As a result, a so-called migration of these metallic crystals occurs. Eventually, the migration causes the pair of electrodes to come in contact with each other, and a short-circuit current I flows across the electrodes, causing apparatus malfunction.

To prevent the above-discussed migration, the metallic conductive layers 221, 222 may be formed only on the outer wiring part Z, with the metallic conductive layers 221, 222 not being formed on either the contact part X or the inner wiring part Y. However, because the amount of carbon particles that can be dispersed in a resin has an upper limit, it is impossible to sufficiently increase the conductivity of the resin conductive layers 231, 232 if so utilized. Furthermore, adherence of the resin conductive layer to the resin film is generally inferior to that of the metallic conductive layer. Therefore, a membrane switch that does not have a metallic conductive layer in the FPCs 21, 22 on the contact part X and the inner wiring part Y cannot be practically used.

SUMMARY OF THE INVENTION

The present invention has been developed to solve the above-described limitations of conventional membrane switches.

An object of the present invention is to suppress a membrane switch short circuit condition by utilizing a structure which inhibits conductive layer metal ions from migrating along the side wall of the spacer cavity.

To overcome the above-discussed limitations associated with conventional membrane switches, a membrane switch according to one embodiment of the present invention includes first and second metallic conductive layers, at least one of which includes a highly conductive metallic material. The conductive layers are provided on an inside surface of first and second resin films, respectively, with at least one of the first and second metallic conductive layers being located a predetermined distance from a spacer cavity periphery. That is, in at least one of first and second resin films, a metallic conductive layer supplying metallic ions is not located in the vicinity of the spacer side wall, as the side wall is the migration growing point.

In the metallic conductive layer located a predetermined distance from the spacer cavity periphery, even when metallic ions are generated due to the presence of moisture, it takes a relatively long period of time for the metallic ions to reach the spacer cavity due to the distance between the conductive layer and the spacer side wall. Therefore, the period of time necessary for the resulting metallic crystals to grow on the side wall of the spacer to a point that the electrodes contact each other is greatly increased, and thus a migration-created short circuit condition can be suppressed.

According to another embodiment of the switch of the present invention, in at least one of a pair of conductive switch parts, a portion of a switch part is formed with a non-metallic conductive layer adjacent the spacer cavity. That is, the non-metallic conductive layer, which does not act as a metallic ion source, is utilized at the periphery of the spacer cavity. Therefore, metallic ion migration can be suppressed. Particularly, in this embodiment, the conductive part includes a single layer composed of a metallic conductive layer, a single layer composed of a non-metallic conductive layer, and a composite layer composed of a metallic conductive layer and a non-metallic conductive layer. In other words, the conductive part refers to the entire body having the three layers, with the conductive part including a single non-metallic conductive layer located at the periphery of the spacer cavity.

DETAILED DESCRIPTION OF THE PREFERRED EMBODIMENTS

Figure 1A:
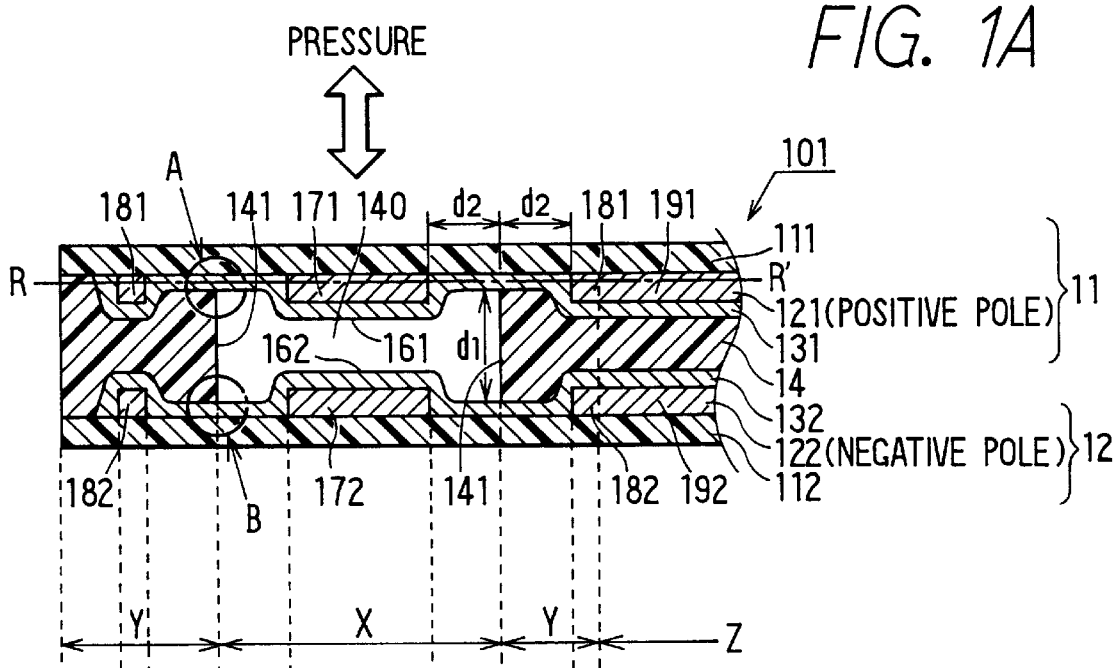
FIG. 1A is a vertical cross sectional view of a membrane switch of a first embodiment of the present invention.

Embodiments of the invention will be described in detail below with reference to the drawings. In the vertical cross sectional views of the membrane switches in the drawings, the scale in the direction of deformation is enlarged for explanatory purposes.

FIG. 1A shows a schematic cross sectional view of a membrane switch 101 according to a first embodiment of the present invention. The membrane switch 101 comprises a first flexible printed circuit (FPC) 11, a second FPC 12, and a spacer 14 sandwiched between the first and second FPCS. The first and second FPCS 11, 12 include first and second resin films 111, 112, respectively. A metallic material having high conductivity, such as copper and silver, having a thickness of for example from 10 to 100 $\mu$m is laminated on the first and second resin films 111, 112, respectively, via an adhesive layer having a thickness of for example from 1 to 10 $\mu$m.

The copper or silver is patterned into a predetermined shape. The shape is formed by a printing method using a silver paste containing a resinous polymer as a binder. Alternatively, the copper or silver may be formed into a foil form and then patterned by an etching technique using a photomask or a photocurable resin. The copper or silver may also be patterned into a prescribed shape by a well-known plating technique.

In the present embodiment, on the first resin film 111, a circular metallic conductive layer of a contact part 171, a metallic conductive layer of an inner wiring part 181, and a metallic conductive layer of an outer wiring part 191 are patterned as a first metallic conductive layer 121.

Similarly, on the second resin film 112, a circular metallic conductive layer of a contact part 172, a metallic conductive layer of an inner wiring part 182 and a metallic conductive layer of an outer wiring part 192 are patterned as a first metallic conductive layer 122. Furthermore, the patterned first metallic conductive layer 121 and the patterned second metallic conductive layer 122 are covered with protective first and second non-metallic conductive layers 131, 132, respectively, to prevent oxidation and corrosion of the metallic conductive layers. The first and second non-metallic conductive layers 131, 132 each are electrically connected to the first and second metallic conductive layers 121, 122, respectively, at a contact part X, an inner wiring part Y and an outer wiring part Z. The surfaces of the first and second non-metallic conductive layers 131, 132 are designated as first and second contact points 161, 162, respectively.

A material used in forming the non-metallic conductive layers 131, 132 is obtained by kneading carbon particles with a resinous polymer, such as polyester, polyether and polycarbonate, as a binder. The non-metallic conductive layers 131, 132 are screen-printed over the patterned metallic conductive layers 121, 122 to a thickness of from 1 to 100 $\mu$m. After printing, the resulting configuration is dried at a temperature of from 100° C. to 120° C. Since the non-metallic conductive layers 131, 132 contain carbon particles, the metallic conductive layers 121, 122 as underlayers are protected without impairing the conductivity thereof. Since the metallic conductive layers 121, 122 have greater conductivity, a current does not substantially flow in the non-metallic conductive layers 131, 132 formed on the metallic conductive layers 121, 122 other than at the contact points 161, 162; rather most of the current flows in the metallic conductive layers 121, 122.

Figure 1B:
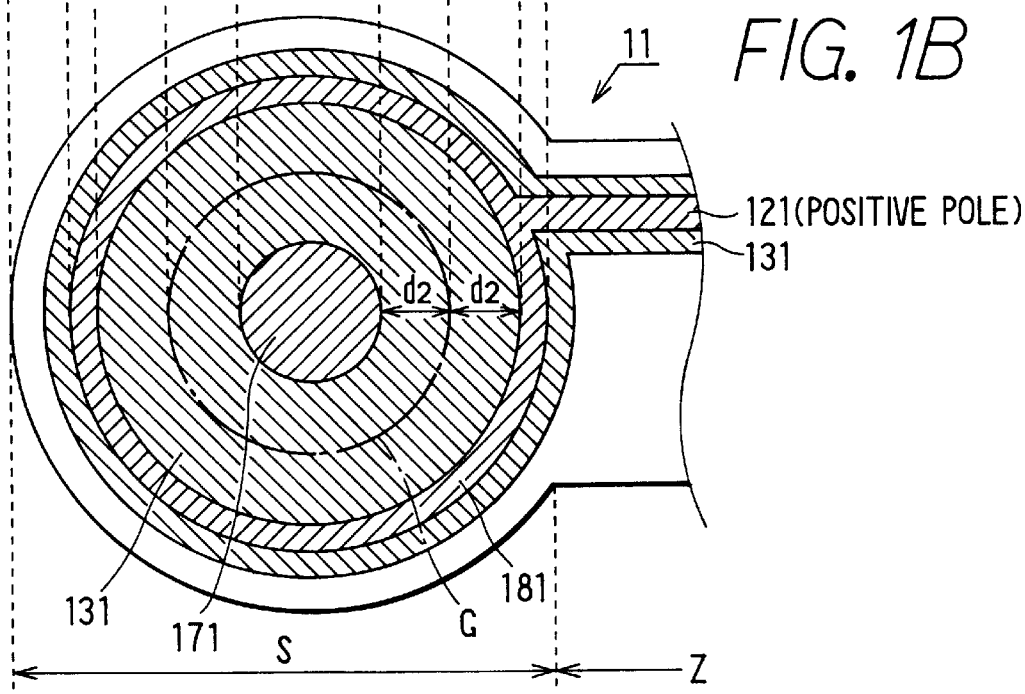
FIG. 1B is a horizontal cross sectional view of a membrane switch of the membrane switch of FIG. 1.

FIG. 1B is a horizontal cross sectional view of the membrane switch shown in FIG. 1A taken on line R-R', and shows the metallic conductive layer 121 of the FPC 11. The metallic conductive layer 121 includes a disk-shaped switch part S and an outer wiring part Z. The disk-shaped switch part is composed of a centrally-positioned contact part 171, and an inner wiring part 181 of a concentric circular form and radially separated from the contact part 171. An outer wiring part 191 is formed in the outer wiring part Z and is connected to the metallic conductive layer of the inner wiring part 181.

The non-metallic conductive layer 131 covers both the inner and outer wiring parts 181, 191 and connects the metallic conductive layer of the contact part 171 and the metallic conductive layer of the inner wiring part 181. The circle G in FIG. 1B shows the location of a cavity defined by the spacer 14. The interior of the circle G corresponds to the contact part X.

It should be appreciated that, in the present embodiment, a metallic conductive layer 122 of like structure is also formed on the FPC 12.

In the membrane switch 101, the FPCs 11, 12 as above-described are arranged in such that the contact parts X oppose each other. The spacer 14 is adhered to the non-metallic conductive layers with an adhesive layer (not shown) in such a manner that the cavity 140 defined by the spacer corresponds to the contact parts X of the FPCs 11, 12. As a result, the cavity 140, is defined by the contact parts X and side walls 141 of the spacer. The membrane switch 101 is typically utilized in an application in which a voltage of from 1 to 100 V is applied to the contact parts X of the FPCs 11, 12. When pressure is applied from the upper side, i.e., the side of the FPC 11, the FPC 11 is deformed, and the contact point 161 of the FPC 11 and the contact point 162 of the FPC 12 come into contact with each other. This contact can be externally detected through metallic conductive outer wiring layers 191, 192.

When the membrane switch gets wet or is subjected to condensation, metallic crystal migration may occur as previously described. However, according to the present embodiment, even when metallic ions are formed in the metallic conductive layers 121, 122, migration is suppressed.

More particularly, migration occurs when: (1) a source of metallic ions is present; (2) water is present to generate the metallic ion; (3) an electric field promoting migration of the metallic ion is present; and (4) metallic ions have a migration route.

Figure 2A:
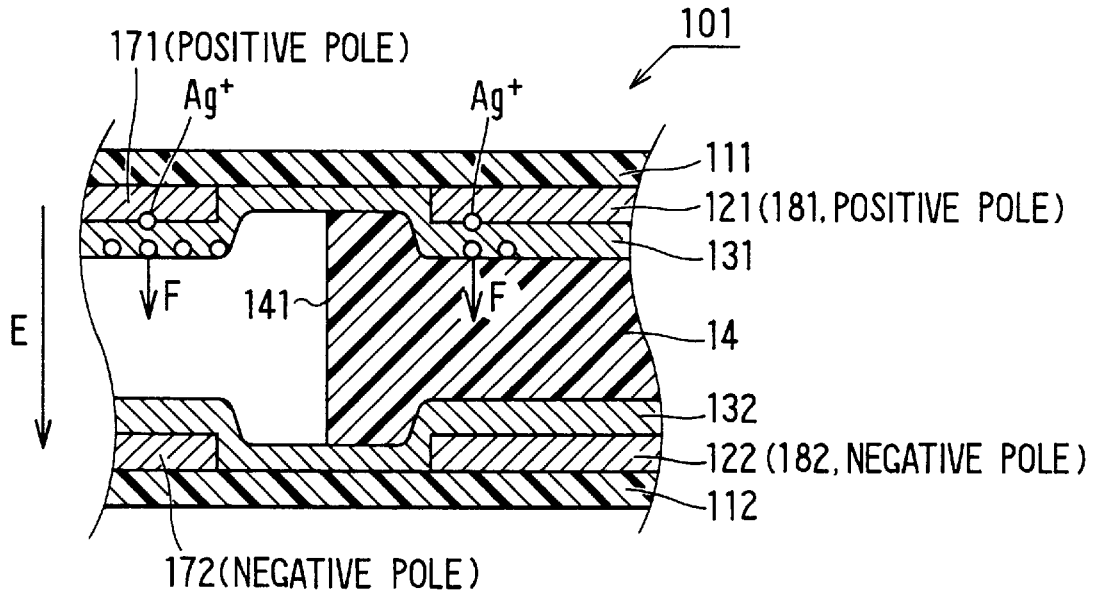
FIG. 2A is an explanatory views showing the positional relationship of metallic ions, the electric field and the migration route for the membrane switch of FIGS. 1A and 1B.
Figure 2B:
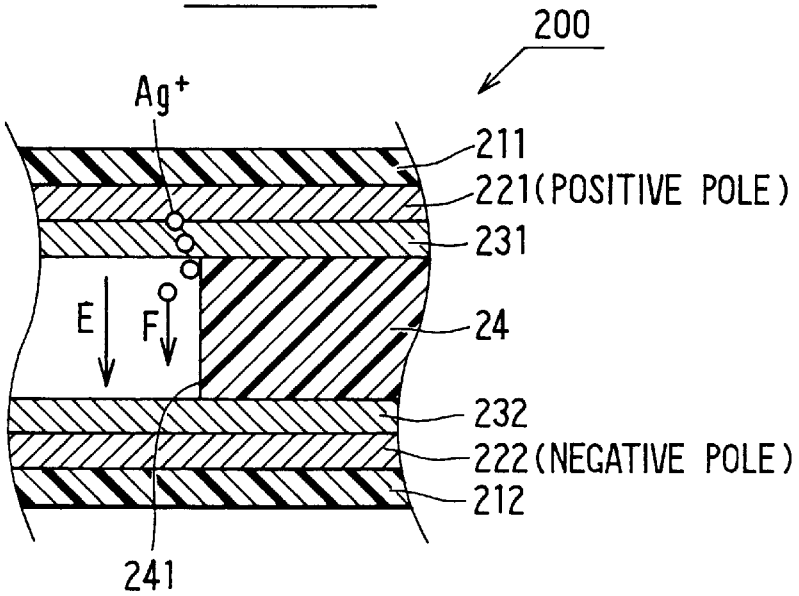
FIG. 2B PRIOR ART
FIG. 2B is an explanatory view showing the positional relationship of metallic ions, the electric field and the migration route for a conventional membrane switch.
Figure 8A:
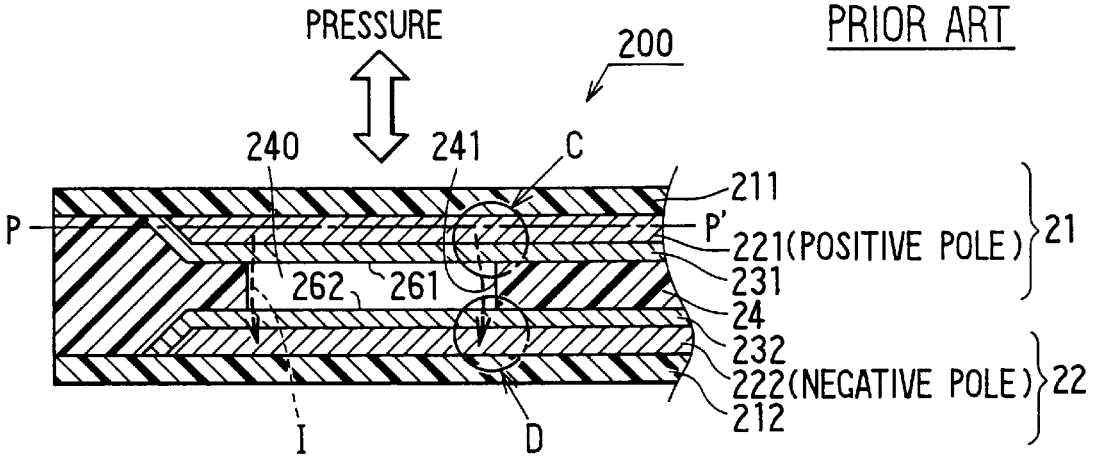
FIG. 8A PRIOR ART
FIGS. 8A and 8B are a vertical cross sectional view and a horizontal cross sectional view, respectively, of a conventional membrane switch.
Figure 8B:
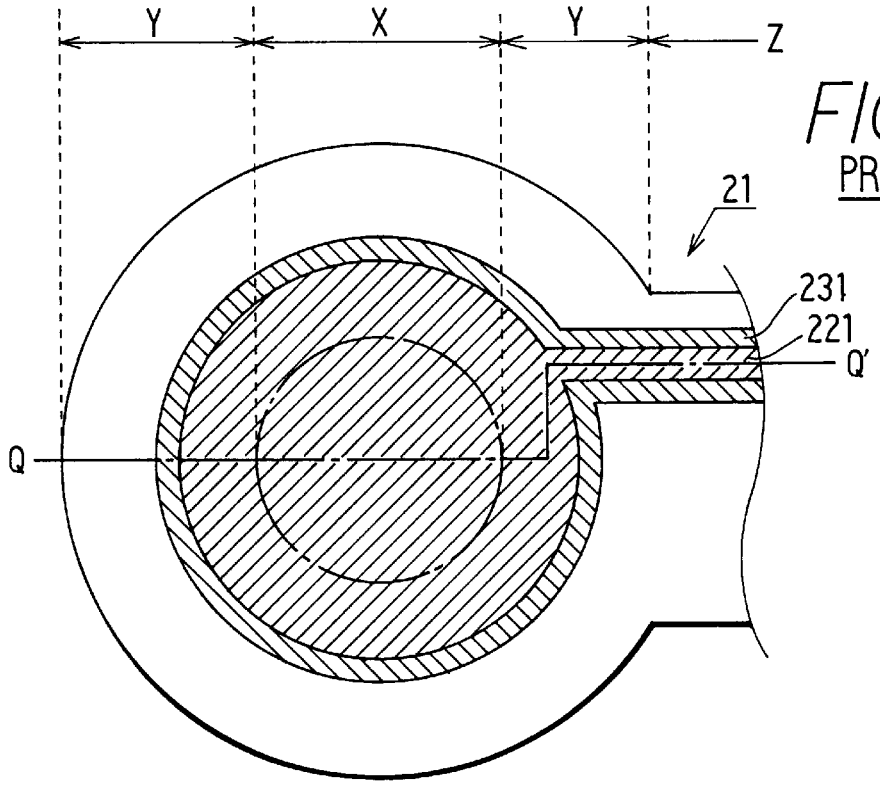
FIG. 8B PRIOR ART

FIG. 2B shows the mechanisms of migration generation in a membrane switch having a conventional structure. FIG. 2B is a partial cross sectional view of prior art conventional membrane switch 200 shown in FIGS. 8A and 8B in the vicinity of the periphery of the spacer cavity designated by C and D in FIG. 8A. In the following description, it is assumed that the metallic conductive layer 221 of the FPC 21 is connected to a positive electrode of an outer circuit, and the metallic conductive layer 222 of the FPC 22 is connected to a negative electrode of an outer circuit. When the membrane switch 200 is in an OFF state, an electric field E is formed between the metallic conductive layer 221 to the metallic conductive layer 222.

As shown in FIG. 2B, when the metallic conductive layer 221 of the positive electrode side, which is a metallic ion source, and the route (the side wall 241 of the cavity of the spacer) are in alignment, migration is liable to occur. A metallic ion $Ag^+$ generated in the metallic conductive layer 221 is acted upon by a force F from the electric field E. Metallic ions at the metallic conductive layer 221 adjacent to the side wall 241 of the spacer cavity gradually move and reach the side wall 241 by passing through the non-metallic conductive layer 231 as shown. Some of the metallic ions reaching the side wall 241 deposit on the side wall 241, while others move further down the side wall 241 toward the negative electrode. The thus-deposited metal grows as tree-like protrusions that eventually reach the non-metallic conductive layer 232 of the negative electrode. As a result, the structure of the conventional membrane switch 200 is compromised when exposed to moisture, as a short circuit is formed between the FPC 21 and the FPC 22 by the above-described metallic ion migration.

In the membrane switch 101 according to the present invention shown in FIGS. 1A and 1B, only the non-metallic conductive layers 131, 132 (conductive resin layers) are formed in the vicinity A and B of the periphery of the cavity of the spacer, with the metallic conductive layers 121, 122 not being formed thereat. As shown in FIG. 2A, the metallic conductive layer 121 of the FPC 11 is connected to a positive electrode of an outer circuit, and the metallic conductive layer 122 of the FPC 12 is connected to a negative electrode of an outer circuit. When the membrane switch 101 is in an OFF state, an electric field E is formed between the metallic conductive layer 121 to the metallic conductive layer 122.

In the present membrane switch 101, the metallic conductive layer 121 of the positive electrode side (the metallic conductive layer 171 of the contact part and the metallic conductive layer 181 of the inner wiring part), which is a metallic ion source, and the route (the side wall 141 of the cavity of the spacer) are distanced from each other, and are not aligned along the direction of the electric field E.

A force F from the electric field E acts on the metallic ions ($Ag^+$ in FIG. 2A, for example) generated in the metallic conductive layer 171 of the contact part. However, even if the metallic ions diffuse to the non-metallic conductive layer 131 due to the force F, the metallic ions are not close to the side wall 141 of the cavity of the spacer by the force F. Therefore, the migration of the metallic ions to the side wall 141 of the cavity of the spacer is considerably slower than in a membrane switch having a conventional structure. The above holds true when metallic ions are generated in the metallic conductive layer 181 of the inner wiring part. Accordingly, even when a metallic ion is generated due to the presence of moisture, the migration time of the metallic ions increases when the contact point is offset as in the present embodiment, and thus migration can be suppressed.

Furthermore, the distances $d_2$ between the edge of the metallic conductive layers 171, 172 of the contact part and the side wall 141, and between the edge of the metallic conductive layers 181, 182 of the inner wiring part and the side wall 141 are at least 10 times the thickness $d_1$ of the spacer 14 as measured at the side wall. By utilizing this type of structure, the membrane switch satisfies the JIS Standard (JIS D0203 R1) automobile part waterproof test.

The metallic conductive layers 171, 172 of the contact part and the metallic conductive layers 181, 182 of the inner wiring part of the FPC 11 and FPC 12 are covered by the non-metallic conductive layers 131, 132. As the conductivity of the metallic conductive layers 121, 122 is greater than that of the non-metallic conductive layers 131, 132, unnecessary electrical resistance can be decreased. Furthermore, the adherence of the metallic conductive layers 121, 122 to the resin films 111, 112 is better than that of the non-metallic conductive layers 131, 132. Therefore, while the metallic conductive layers 121, 122 are a metallic ion source, the membrane switch according to the presently-described embodiment exhibits excellent mechanical as well as electrical properties.

Further, it should be appreciated that, in the present embodiment, the positive electrode and the negative electrode need not be distinguished from each other.

Figure 3:
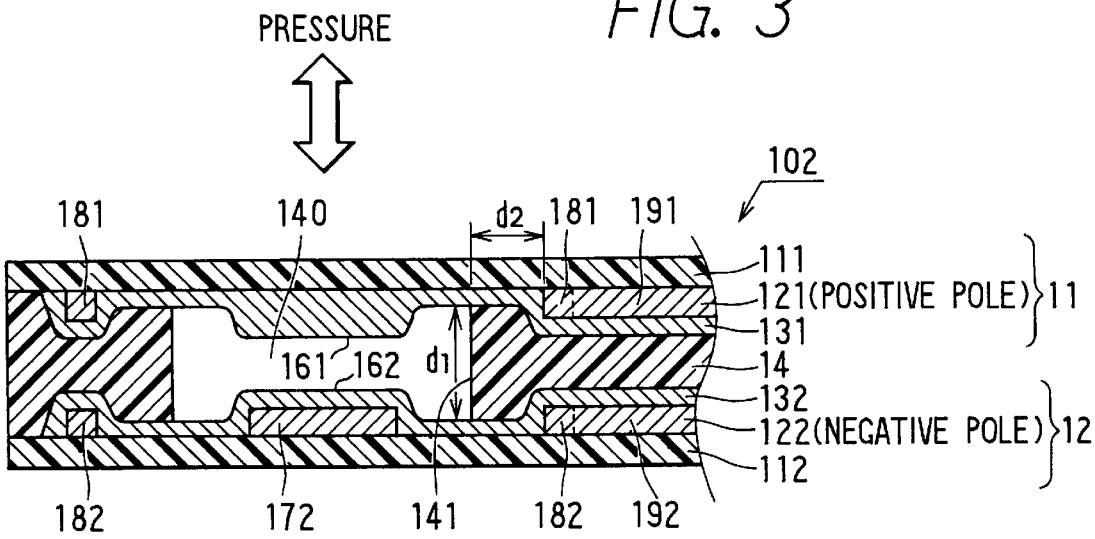
FIG. 3 is a vertical cross sectional view of a membrane switch according to a second embodiment of the present invention.

FIG. 3 shows a vertical cross sectional view of a membrane switch 102 according to a second embodiment of the present invention. Like numerals reference like elements also shown in FIGS. 1A and 1B. This second embodiment is particularly useful when applied to a membrane switch of relatively large scale.

The second embodiment differs from the first embodiment in that the metallic conductive layer 171 of the contact part is not used in the contact part X of the positive electrode side. Instead, only the non-metallic conductive layer 131 is used. Therefore, the generation of metallic ions in the contact part X of the positive electrode side can be suppressed, and thus malfunction due to short circuit caused by migration can be suppressed.

In the membrane switch 102, as in the first embodiment, the distances $d_2$ between the metallic conductive layers 181, 182 of the inner wiring part and the side wall 141 of the cavity of the spacer is preferably at least 10 times that of the thickness $d_1$ of the spacer 14, thereby enabling the switch to satisfy the JIS Standard (JIS D0203 R1) test.

Figure 4:
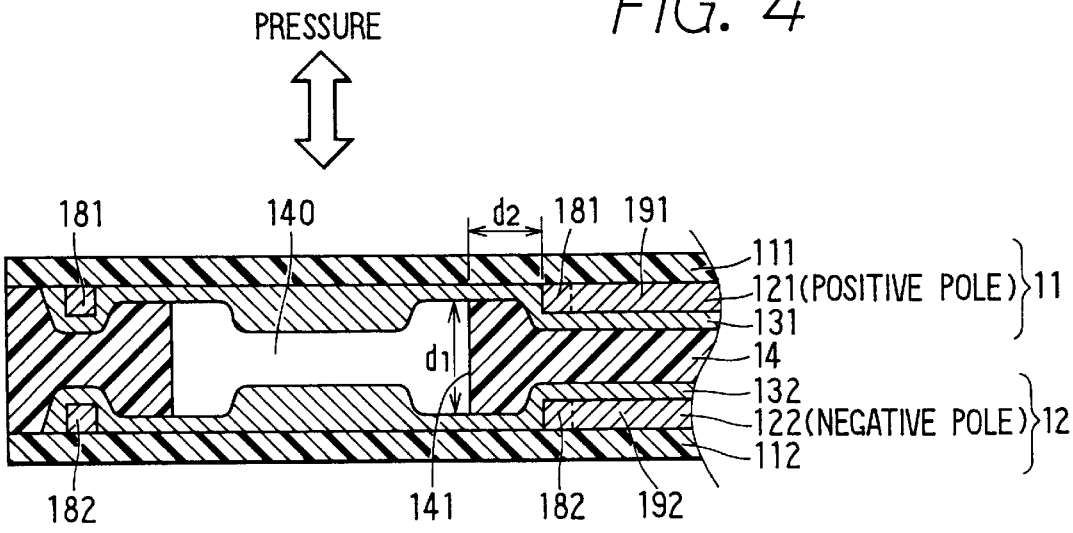
FIG. 4 is a vertical cross sectional view of a membrane switch according to a third embodiment of the present invention.

FIG. 4 shows a vertical cross sectional view of a membrane switch 103 according to a third embodiment of the present invention. Like numerals reference like elements also shown in FIGS. 1A and 1B. This embodiment can be applied to a membrane switch of relatively large scale for small electric power. The third embodiment differs from the first and second embodiments in that neither of the metallic conductive layers 171, 172 of the contact parts is used in the contact parts X of either of the FPCs 11, 12. Rather, only the non-metallic conductive layers 131, 132 are used. Therefore, the generation of metallic ions in the contact part X of the positive electrode side can be suppressed, and thus malfunction due to a short circuit caused by migration can suppressed.

As the membrane switch 103 does not include the metallic conductive layers 171, 172, the electric resistance of the switch increases slightly. Therefore, the present embodiment is preferably used as a membrane switch of relatively large scale for small electric power applications. In this embodiment, the positive electrode and the negative electrode need not be distinguished from each other as in the first embodiment. Furthermore, by making the distances $d_2$ between the metallic conductive layers 181, 182 of the inner wiring part and the side wall 141 of the cavity of the spacer at least 10 times the thickness $d_1$ of the spacer 14, the membrane switch can satisfy the aforementioned JIS Standard (JIS D0203 R1).

While three embodiments of the present invention have been described above, various modified examples are also contemplated.

Particularly, films which are waterproof or which are semi-water permeable may be used as the resin films 111, 112. For example, the film may be a polyester film coated with a porous polyurethane or a porous fluorine resin to a thickness of from 1 to 100 $\mu$m that transmits moisture but does not transmit water droplets having a diameter of 1 $\mu$m or more. By using a film of such a material, the humidity at the cavity always becomes the same as the humidity outside of the switch. Therefore, if the membrane switch gets wet, humidity within the spacer cavity approaches that of the surrounding outside environment, and migration due to moisture is substantially suppressed.

Figure 5:
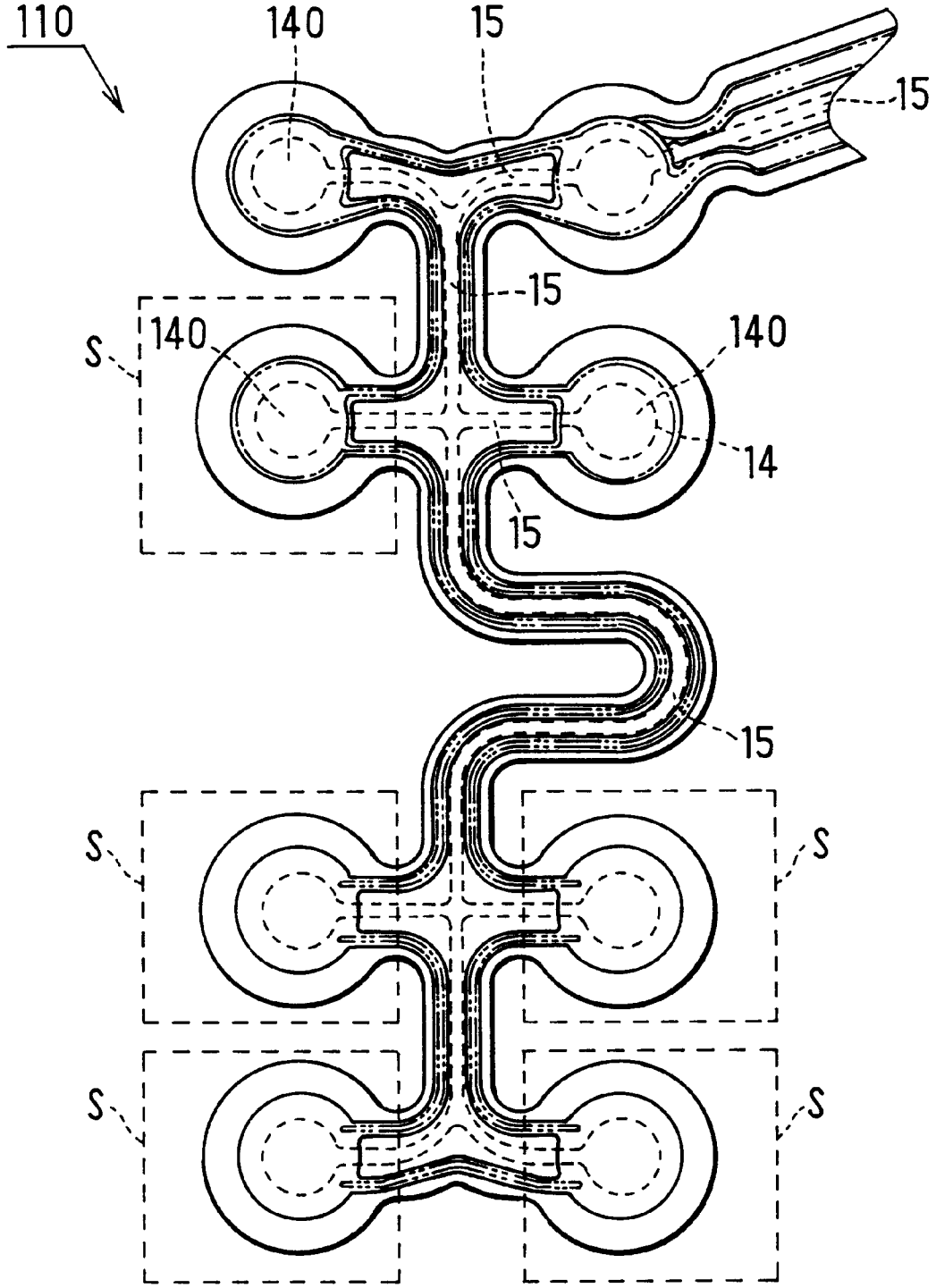
FIG. 5 is a plan view of the membrane switch according to a modified embodiment of the invention.

Alternatively, the spacer cavity 140 shown in FIGS. 1A, 1B, 3 and 4 may open to the outside environment. FIG. 5 shows a plan view of the membrane switch 110, in which a number of switch parts S are connected in parallel. A groove 15 connecting the cavity 140 to the outside is formed in each of the switch parts of the spacers 14. By utilizing such a structure, when the switch is exposed to moisture, the grooves facilitate moisture evaporation, the cavity 140 thus does not remain exposed to moisture for a long period of time, and the above-discussed migration can be suppressed.

In the first, second and third embodiments, only the non-metallic conductive layers 131, 132 are formed in the vicinity A and B of the circumference of the cavity of the spacer, while the metallic conductive layers 121, 122 are not formed. However, since the migration of the metallic ions is primarily generated from the positive electrode side, the metallic conductive layer may be formed in the negative electrode side.

Figure 6:
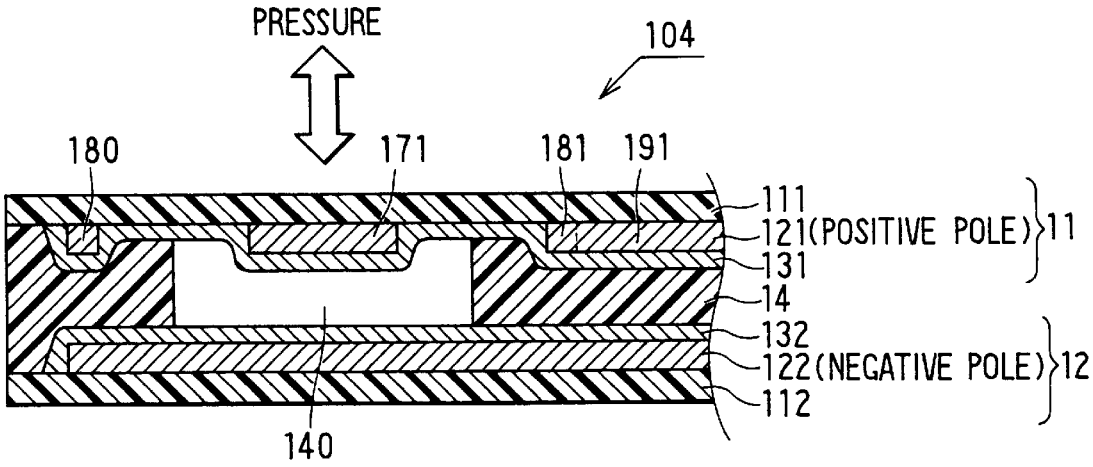
FIG. 6 is a vertical cross sectional view of a membrane switch according to another modified embodiment of the invention.
Figure 7A:
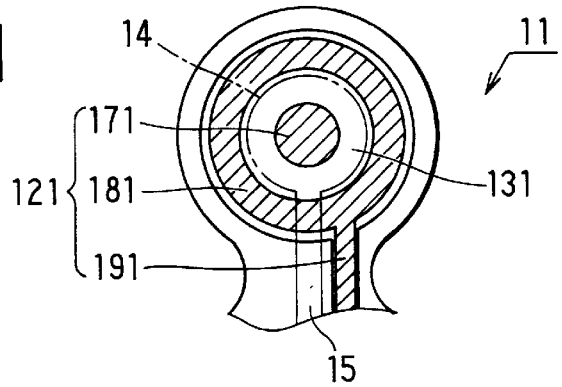
FIG. 7 is a plan view of the membrane switch of FIG. 6.
Figure 7B:
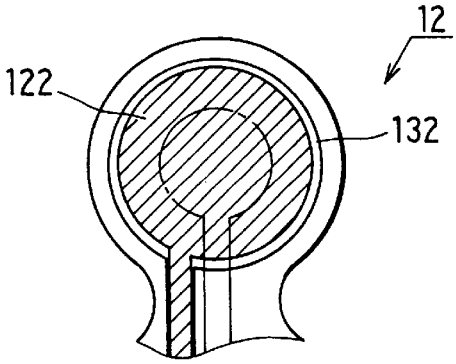

Accordingly, the membrane switch of FIG. 6 may be used with polarity being distinguished, and in which the metallic conductive layer 122 of the negative electrode side is continuous from the contact part X to the inner wiring part Y, as shown in FIG. 6. FIG. 7A also shows the structure of the positive electrode side, and FIG. 7B shows the structure of the negative electrode side.

Figure 7C:
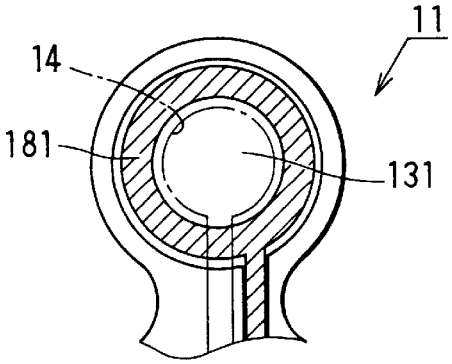

Furthermore, as shown in FIG. 7C of the structure of the positive electrode side, the metallic conductive layer 181 of the positive electrode side may alternatively not be provided in the FIG. 6 structure.

It should be noted that the opposing members need not directly oppose one another. For example, the metallic conductive layer 171 of the first contact part and the metallic conductive layer 172 of the second contact part may be formed to not directly oppose one another, and the layers may have differing shapes.

Similarly, the opposing metallic conductive layers 191, 192 of the outer wiring part need not be formed in a directly opposing configuration. Furthermore, the outer wiring part may not have a non-metallic conductive layer, and a conductive part may be formed with a single layer of the metallic conductive layer.

While the above description is of the preferred embodiments of the present invention, it should be appreciated that the invention may be modified without departing from the proper scope or fair meaning of the accompanying claims. Various other advantages of the present invention will become apparent to those skilled in the art after having the benefit of studying the foregoing text and drawings taken in conjunction with the following claims.

What is claimed is:

1. A membrane switch, comprising:

first and second resin films;

first and second metallic conductive layers each formed from a highly conductive metallic material and being fixed to inner surfaces of the first and second resin films, respectively;

first and second non-metallic conductive layers covering the first and second metallic conductive layers, respectively; and a spacer for separating the first and second non metallic conductive layers and having an inner wall that in combination with the non-metallic conductive layers defines a spacer cavity;

wherein at least one of the first and second metallic conductive layers is located in other than the thickness direction of a periphery of the spacer cavity.

2. The membrane switch of claim 1, wherein the first metallic conductive layer comprises a first contact part and a first wiring part located a prescribed distance from the first contact part, the first contact part and the first wiring part being connected by the first non-metallic conductive layer, the inner wall of the spacer being positioned between the first contact part and the first wiring part; and the second metallic conductive layer comprises a second contact part opposing the first contact part, and a second wiring part located a prescribed distance from the second contact part and opposing the first wiring part, the second contact part and the second wiring part being connected by the second non-metallic conductive layer, the inner wall of the spacer being positioned between the second contact part and the second wiring part.

3. The membrane switch of claim 2, wherein a distance between the first contact part and walls of the spacer is at least 10 times in length greater than a length of the inner wall of the spacer as measured in a spacer thickness direction.

4. The membrane switch of claim 1, wherein the first metallic conductive layer is formed by a first wiring part connected to a first contact part, the first contact part forming the first non-metallic conductive layer; and the second metallic conductive layer is formed from a second contact part opposing the first contact part, and a second wiring part located a prescribed distance from the second contact part, the second contact part and the second wiring part being connected by the second non-metallic conductive layer, the inner wall of the spacer being positioned between the second contact part and the second wiring part.

5. The membrane switch of claim 1, wherein the first metallic conductive layer is formed from a first wiring part connected to a first contact part, the first contact part being the first non-metallic conductive layer; and the second metallic conductive layer is formed from a second wiring part connected to a second contact part, the second contact part being the second non-metallic conductive layer, the first contact part and the second contact part being capable of contacting each other, the inner wall of the spacer being a prescribed distance from one of the first and second wiring parts.

6. The membrane switch of claim 1, wherein a distance between the first wiring part and the inner wall of the spacer is at least 10 times greater in length than a length of the inner wall of the spacer as measured in a spacer thickness direction.

7. The membrane switch of claim 1, wherein the first metallic conductive layer is a positive electrode, and the second metallic conductive layer is a negative electrode.

8. The membrane switch of claim 1, wherein the first and second resin films are moisture permeable to exhaust condensation to a switch external environment.

9. The membrane switch of claim 1, wherein the spacer defines a groove for connecting the spacer cavity with a switch external atmosphere.

10. The membrane switch of claim 1, wherein at a switch positive electrode the first metallic contact layer comprises a first contact part and a first wiring part located a prescribed distance from the first contact part, the first contact part and the first wiring part being connected by the first non-metallic conductive layer; and the second metallic conductive layer comprises a continuous conductive layer at a switch negative electrode forming both a second contact part and a second wiring part.

11. The membrane switch of claim 10, wherein the first metallic contact layer and the first non-metallic contact layer form a raised contact surface, and the continuous conductive layer of the second metallic conductive layer is substantially planar.

* * * * *